US005690247A

United States Patent [19]

Boover

[11] Patent Number: 5,690,247

[45] Date of Patent: Nov. 25, 1997

[54] WASTEBASKET FOR REMOVING AND RETAINING A TRASH CAN LINER

[76] Inventor: Richard C. Boover, 3869 W. Loyola Dr., Kenner, La. 70062

[21] Appl. No.: 738,090

[22] Filed: Oct. 25, 1996

[51] Int. Cl.[6] ..... B65D 25/00

[52] U.S. Cl. ..... 220/403; 220/404; 220/908

[58] Field of Search ..... 220/403, 404, 220/908, 628

[56] References Cited

U.S. PATENT DOCUMENTS

| | | | |
|---|---|---|---|
| 4,363,417 | 12/1982 | Rhoades et al. | 220/908 X |
| 4,416,197 | 11/1983 | Kehl | 220/908 X |
| 4,558,796 | 12/1985 | Jaicks | 220/908 X |
| 4,576,310 | 3/1986 | Isgar et al. | 220/403 X |
| 4,995,529 | 2/1991 | Sher | 220/908 X |
| 5,163,579 | 11/1992 | Jones | 220/908 X |
| 5,174,468 | 12/1992 | Holderman | 220/403 X |
| 5,388,717 | 2/1995 | LeVassur | 220/908 X |
| 5,518,136 | 5/1996 | Muldner et al. | 220/404 |

*Primary Examiner*—Steven M. Pollard

[57] ABSTRACT

A wastebasket for receiving a trash can liner and for facilitating the ready removal of the liner from the wastebasket. The wastebasket includes a main body portion in a generally rectilinear configuration. The upper edge of the front wall is at an elevation lower than the upper edge of the rear wall. Two side walls have parallel horizontal lower edges and parallel upper edges and parallel vertical side edges therebetween. A generally rectangular bottom wall with front, rear and side edges couples the lower edges of the front, rear and side walls. A plurality of apertures are formed in the front and side walls adjacent to the bottom wall to facilitate the removal of a trash liner by allowing for release of suction of a liner located upon and supported by the upper edges of the front, rear and side walls. Further included are designs associated with the bottom wall for receiving the forward portion of a foot of a user to hold the wastebasket against a recipient supporting surface during the removal of the liner. These designs include a foot-shaped recess at the base of the wastebasket and two flat ledges extending outwardly forwardly and laterally from the base of the wastebasket at floor level.

2 Claims, 3 Drawing Sheets

WASTEBASKET FOR REMOVING AND RETAINING A TRASH CAN LINER

BACKGROUND OF THE INVENTION

1. Field of the Invention

The present invention relates to a new and improved wastebasket for removing and receiving a trash can liner and, more particularly, pertains to holding a trash can liner in place within a wastebasket with associated components to facilitate the ready removal of the liner from the wastebasket.

2. Description of the Prior Art

The use of wastebaskets, trash cans and like receptacles of various designs and configurations is known in the prior art. More specifically, wastebaskets, trash cans and like receptacles of various designs and configurations heretofore devised and utilized for the purpose of disposing of trash efficiently through a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for the receipt of trash. By way of example, U.S. Pat. No. 4,027,774 to Cote; U.S. Pat. No. 4,189,808 to Brown; U.S. Pat. No. 5,147,056 to Ma; U.S. Pat. No. 5,372,271 to Miller et al.; U.S. Pat. No. Des. 312,160 to Calvi; and U.S. Pat. No. Des. 322,700 to O'Donnell all disclose devices for use with wastebasket liners or the like.

In this respect, the wastebasket for removing and receiving a trash can liner according to the present invention substantially departs from the conventional concepts and designs of the prior art, and in doing so provides an apparatus primarily developed for the purpose of facilitating the ready removal of a trash can liner within the wastebasket and for utilizing an elastic band with the liner to enhance neatness and sanitation.

Therefore, it can be appreciated that there exists a continuing need for a new and improved wastebasket for removing and receiving a trash can liner which can be used for holding a trash can liner in place within a wastebasket with associated components to facilitate the ready removal of the liner from the wastebasket. In this regard, the present invention substantially fulfills this need.

SUMMARY OF THE INVENTION

In view of the foregoing disadvantages inherent in the known types of wastebaskets, trash cans and like receptacles of various designs and configurations now present in the prior art, the present invention provides an improved wastebasket for removing and receiving a trash can liner. As such, the general purpose of the present invention, which will be described subsequently in greater detail, is to provide a new and improved wastebasket for removing and receiving a trash can liner and methods which have all the advantages of the prior art and none of the disadvantages.

To attain this, the present invention essentially comprises a new and improved wastebasket for receiving trash can liners and for facilitating the ready removal of the liner from the wastebasket comprising, in combination, a main body portion in a generally rectilinear configuration with a rectangular rear wall having parallel upper and lower edges and parallel vertical side edges therebetween; a rectangular front wall having parallel horizontal upper and lower edges and parallel vertical side edges therebetween, the upper edge of the front wall being at an elevation lower than the upper edge of the rear wall; two side walls having parallel horizontal lower edges and parallel upper edges and parallel vertical side edges therebetween, and with the upper edges of the side walls at between about 5 and 15 degrees from the horizontal; a generally rectangular bottom wall with front, rear and side edges coupling the lower edges of the front, rear and side walls, the bottom wall being formed with two generally flat ledges at floor level extending outwardly, forwardly and laterally, from side walls for the placing of a foot or feet of a user to hold down the wastebasket against the upward force of the trash can liner during the removal of the liner; a foot-shaped recess formed centrally in the front wall adjacent the bottom wall thereof for receiving the forward portion of a foot of a user to hold the wastebasket against a recipient supporting surface during the removal of the liner; a plurality of apertures formed in the front, side and rear walls adjacent to the bottom wall to allow for release of suction to a liner located upon the interior walls and supported by the upper edges of the front, rear and side walls; an eyelet or hook extending outwardly from one of the side walls adjacent to the upper edge thereof; an enlarged bead formed around the upper edges of the front, rear and side walls to assist in the proper location of the elastic band over the trash can liner during operation and use; and an elastic band removably positioned on the eyelet or hook for storage and also positionable adjacent to the upper edges of the front, rear and side walls over the upper edge of a liner and beneath the bead to assist in retaining the liner within the wastebasket during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wastebasket for removing and receiving a trash can liner which has all the advantages of the prior art wastebaskets, trash cans and like receptacles of various designs and configurations and none of the disadvantages.

It is another object of the present invention to provide a new and improved wastebasket for removing and receiving a trash can liner which may be easily and efficiently manufactured and marketed.

It is a further object of the present invention to provide a new and improved wastebasket for removing and receiving a trash can liner which is of a durable and reliable construction.

An even further object of the present invention is to provide a new and improved wastebasket for removing and receiving a trash can liner which is susceptible of a low cost of manufacture with regard to both materials and labor, and which accordingly is then susceptible of low prices of sale to the consuming public, thereby making such wastebaskets, trash cans and like receptacles of various designs and configurations economically available to the buying public.

Even still another object of the present invention is to hold a trash can liner in place within a wastebasket with associated components to facilitate the ready removal of the liner from the wastebasket.

Lastly, it is an object of the present invention to provide a wastebasket for receiving a trash can liner and for facilitating the ready removal of the liner from the wastebasket. The wastebasket includes a main body portion in a generally rectilinear configuration. The upper edge of the front wall is at an elevation lower than the upper edge of the rear wall. Two side walls have parallel horizontal lower edges and parallel upper edges and parallel vertical side edges therebetween, the upper edges of the side walls being at between about 5 and 15 degrees from the horizontal. A generally rectangular bottom wall with front, rear and side edges couples the lower edges of the front, rear and side walls. A plurality of apertures are formed in the front and side walls adjacent to the bottom wall to facilitate the removal of a trash liner by allowing for release of suction of a liner located upon and supported by the upper edges of the front, rear and side walls. Further included are designs associated with the bottom wall for receiving the forward portion of a foot or feet of a user to hold the wastebasket against a recipient supporting surface during the removal of the liner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
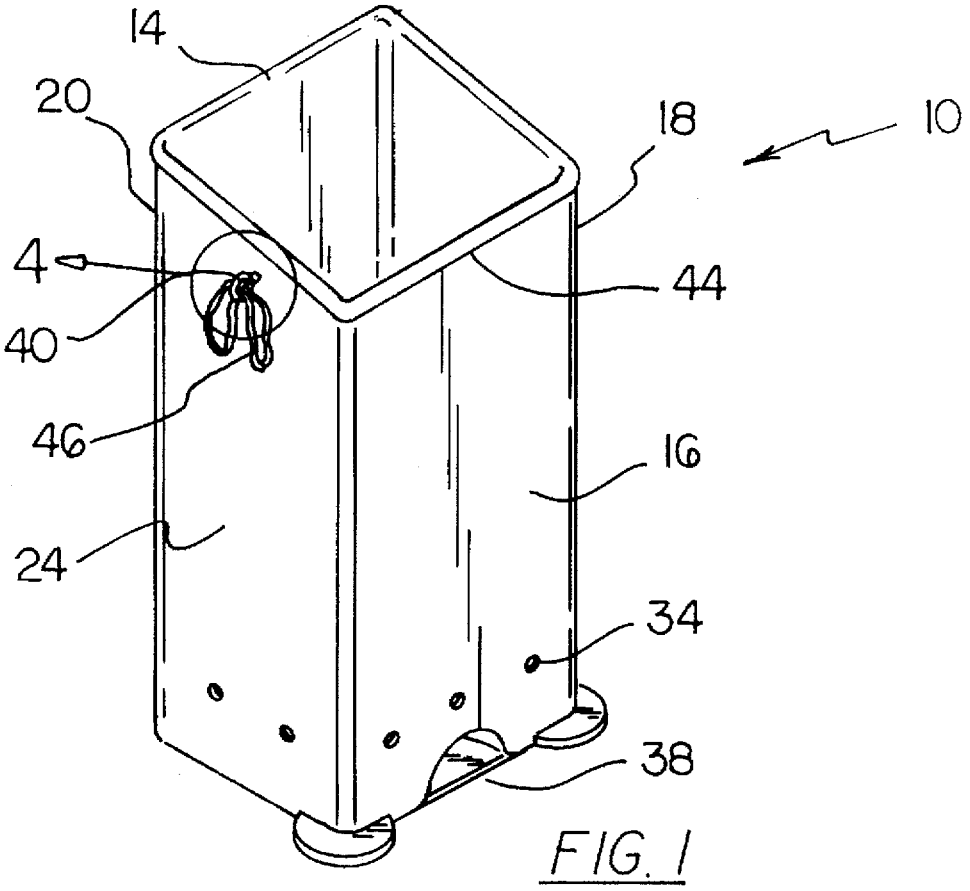
FIG. 1 is a perspective view of the preferred embodiment of the new and improved wastebasket for removing and receiving a trash can liner constructed in accordance with the principles of the present invention.
Figure 2:
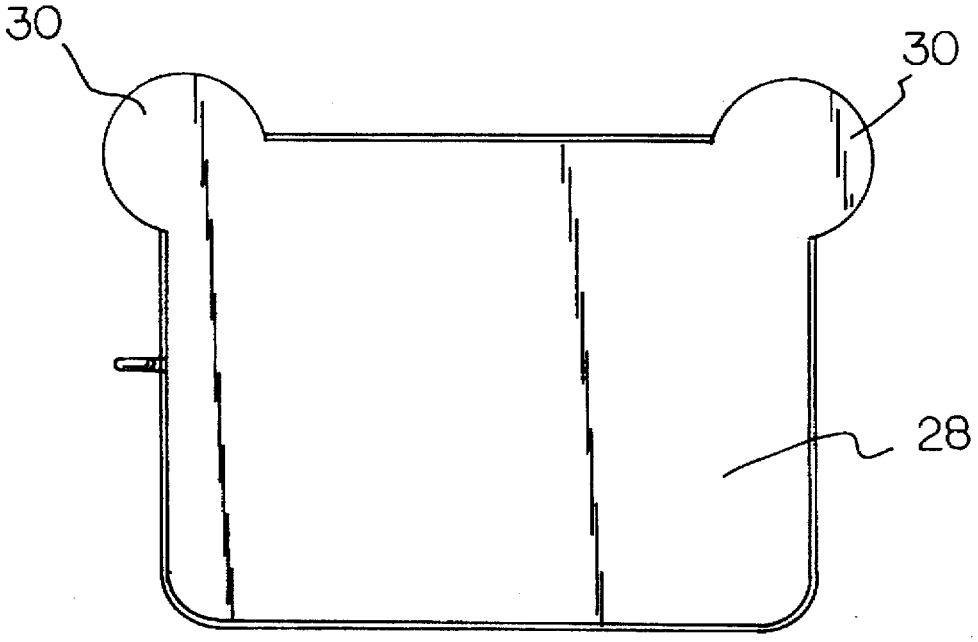
FIG. 2 is a bottom elevational view of the wastebasket shown in FIG. 1.
Figure 3:
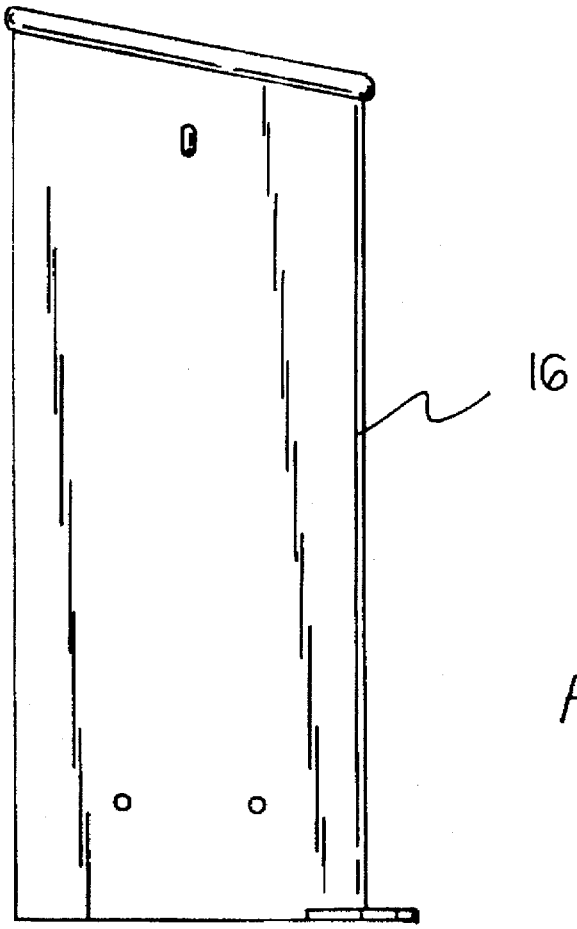
FIG. 3 is a right side elevational view of the wastebasket shown in FIGS. 1 and 2.
Figure 4:
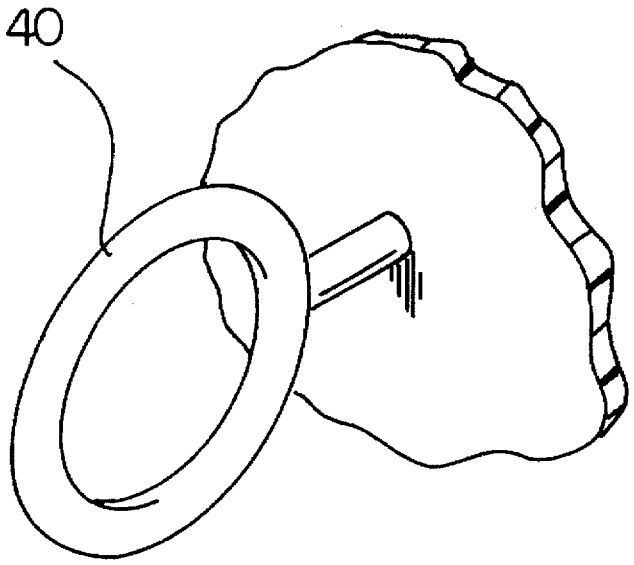
FIG. 4 is a enlarged perspective illustration of the eyelet shown in FIG. 1 taken at circle 4 of FIG. 1.
Figure 5:
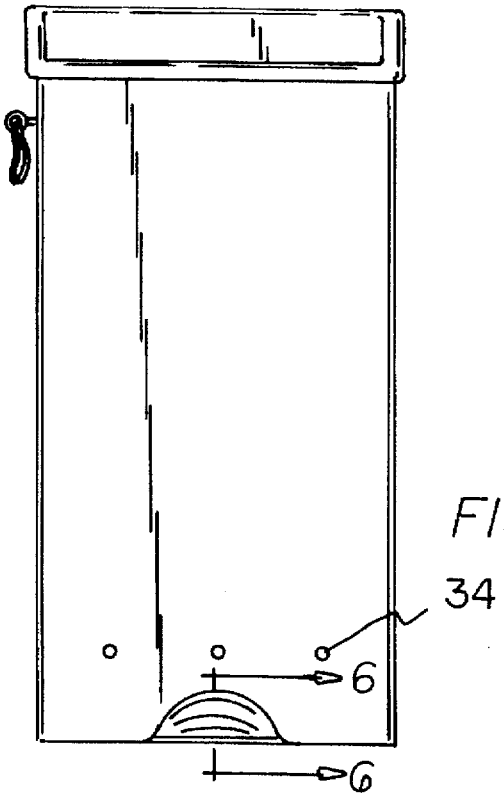
FIG. 5 is a front elevational view of the wastebasket shown in FIGS. 1–3.
Figure 6:
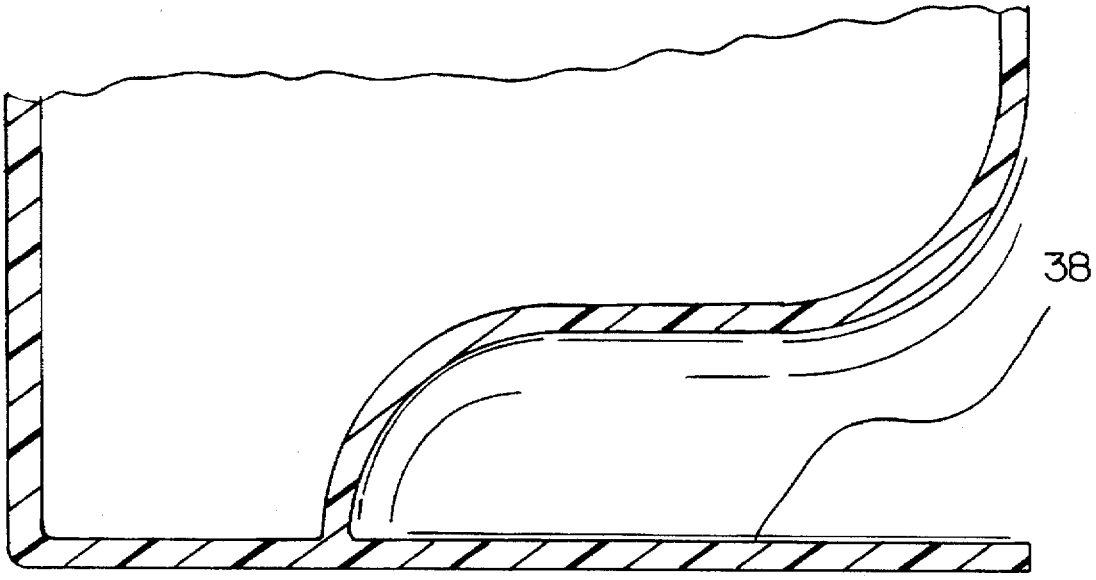
FIG. 6 is a cross-sectional view taken at line 6—6 of FIG. 5.

With reference now to the drawings, and in particular to FIG. 1 thereof, the preferred embodiment of the new and improved wastebasket for removing and receiving a trash can liner embodying the principles and concepts of the present invention and generally designated by the reference numeral 10 will be described.

The present invention, the new and improved wastebasket for removing and receiving a trash can liner, as illustrated in FIG. 1, comprises a plurality of components. In their broadest context, the components include a main body portion, apertures, two flat foot ledges, a foot-shaped recess, an eyelet, an enlarged bead, and an elastic band. Each of the individual components is specifically configured and correlated one with respect to the other so as to attain the desired objectives.

The central component of the system 10 of the present invention is a main body portion 12. The main body portion is formed in a generally rectilinear configuration. It is formed to have a rectangular rear wall 14. The rear wall has parallel upper and lower horizontal edges. The rectangular rear wall also has parallel vertical side edges between the upper and lower edges. Next provided as a component of the main body portion is a rectangular front wall 16. Such front wall has parallel horizontal upper and lower edges and parallel vertical side edges between the upper and lower edges. The upper edge 18 of the front wall is at an elevational location lower than the upper edge 20 of the rear wall.

Also formed as part of the main body portion are two side walls 24. The side walls have parallel horizontal lower edges. The side walls also have parallel upper edges as well as parallel vertical side edges between the upper and lower edges. The side walls are formed to have their upper edges at an angle of between about 5 and 15 degrees from the horizontal.

Lastly provided as a component of the main body portion is a generally rectangular bottom wall 28. The bottom wall is formed with front, rear and side edges. The side edges couple the lower edges of the front, rear and side walls. In addition, the bottom wall is formed with generally flat ledge extensions 30 for the placing of a foot or feet of a user to hold down the wastebasket against the upward force of the trash can liner during the removal of the liner.

Operability of the wastebasket is enhanced through the use of a plurality of apertures 34. Such apertures are formed in the front, side and rear walls. They are at a lower orientation adjacent to the bottom wall. Preferably three such apertures are located on the front wall, three on the back wall and two on each of the side walls. The apertures allow for the release of suction holding a liner when the liner is located upon and supported by the upper edges of the front, rear and side walls with the main portion of the liner extending downwardly to the upper surface of the bottom wall.

An additional feature for utility is a foot-shaped recess 38. Such recess is formed centrally in the front wall adjacent to the bottom wall. The bottom wall of the main body portion is also the top and side walls of the foot-shaped recess. Such recess is for receiving the forward portion of a foot of a user. It acts to hold the wastebasket against the recipient supporting surface, thus anchoring the wastebasket to the floor during the removal of a trash can liner from the wastebasket.

An eyelet or hook 40 is also formed into the main body portion. The eyelet or hook is adapted to extend outwardly from one of the side walls. It is located adjacent to the upper edge of the main body portion.

Formed around the upper edges of the front, rear and side walls is an enlarged bead 44. The bead functions to assist in the proper location of an elastic band 46. Such elastic band is adapted to be positioned over the trash can liner during operation and use of the wastebasket and liner when combined.

Lastly provided are the elastic bands 46. The elastic bands are removably positioned on the hook for storage. The elastic bands may then singly be also positionable adjacent to the upper edge of the front, rear and side walls. In such location, the elastic bands are located over the upper edge of the liner and beneath the bead. The elastic band thus functions to assist in retaining the liner within the wastebasket during operation and use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved wastebasket for receiving trash can liners and for facilitating the ready removal of the liner from the wastebasket comprising, in combination:

a main body portion in a generally rectilinear configuration with a rectangular rear wall having parallel upper and lower edges and parallel vertical side edges therebetween, a rectangular front wall having parallel horizontal upper and lower edges and parallel vertical side edges therebetween, the upper edge of the front wall being at an elevation lower than the upper edge of the rear wall, two side walls having parallel horizontal lower edges and parallel upper edges and parallel vertical side edges therebetween, and with the upper edges of the side walls at between about 5 and 15 degrees from the horizontal, a generally rectangular bottom wall with front, rear and side edges coupling the lower edges of the front, rear and side walls, the bottom wall being formed with generally circular extensions extending outwardly forwardly and laterally for the placing of a foot or feet of a user to hold down the wastebasket against the upward force of the trash can liner during removal of the liner;

a plurality of apertures formed in the front, side and rear walls adjacent to the bottom wall to allow for release of suction to a liner located upon and supported by the upper edges of the front, rear and side walls;

a foot-shaped recess formed centrally in the front wall adjacent the bottom wall thereof for receiving the forward portion of a foot of a user to hold the wastebasket against a recipient supporting surface during the removal of the liner;

an eyelet or hook extending outwardly from one of the side walls adjacent to the upper edge thereof;

an enlarged bead formed around the upper edges of the front, rear and side walls to assist in the proper location of the elastic band over the trash can liner during operation and use; and an elastic band removably positioned on the eyelet or hook for storage and also positionable adjacent to the upper edges of the front, rear and side walls over the upper edge of a liner and beneath the bead to assist in retaining the liner within the wastebasket during operation and use.

2. A wastebasket for receiving a trash can liner and for facilitating the ready removal of the liner from the wastebasket comprising:

a main body portion in a generally rectilinear configuration with a rectangular rear wall having parallel upper and lower edges and parallel vertical side edges therebetween, a rectangular front wall having parallel horizontal upper and lower edges and parallel vertical side edges therebetween, the upper edge of the front wall being at an elevation lower than the upper edge of the rear wall, two side walls having parallel horizontal lower edges and parallel upper edges and parallel vertical side edges therebetween, and with the upper edges of the side walls at between about 5 and 15 degrees from the horizontal, a generally rectangular bottom wall with front, rear and side edges coupling the lower edges of the front, rear and side walls;

a plurality of apertures formed in the front and side walls adjacent to the bottom wall to facilitate the removal of a trash liner by allowing for release of suction of a liner located upon and supported by the upper edges of the front, rear and side walls; and means associated with the bottom wall for receiving the forward portion of a foot of a user to hold the wastebasket against a recipient supporting surface during the removal of the liner;

said last mentioned means including multiple projections, each projection extending outwardly from the front edge and a side edge for the placing of a foot or feet of a user to hold down the wastebasket against the upward force of the trash can liner during the removal of the liner, the last mentioned means further including a foot-shaped recess formed centrally in the front wall at the bottom wall, the recess running lengthwise towards the rear wall having a top, bottom and sides that are incorporated into the bottom wall of the wastebasket for receiving the forward portion of a foot of a user to hold the wastebasket against a recipient supporting surface during the removal of the liner.

* * * * *